United States Patent [19]

Hong

[11] Patent Number: 4,597,199

[45] Date of Patent: Jul. 1, 1986

[54] SAFETY SHOE

[76] Inventor: Steve Hong, No.590-2, Chung Cheng Road, Tsao Tun Chen, Taichung, Taiwan

[21] Appl. No.: 698,696

[22] Filed: Feb. 6, 1985

[51] Int. Cl.[4] ..... A43B 5/00; A43B 23/08; A43B 23/10

[52] U.S. Cl. ..... 36/114; 36/77 R; 36/72 R

[58] Field of Search ..... 36/107, 108, 72 R, 72 A, 36/114, 77 R

[56] References Cited

U.S. PATENT DOCUMENTS

| | | | |
|---|---|---|---|
| 1,224,655 | 5/1917 | Lloyd | 36/107 |
| 1,742,763 | 1/1930 | Gerard | 36/72 R |
| 2,160,768 | 5/1939 | Wasser | 36/72 R |
| 2,393,810 | 1/1946 | Purinton | 36/72 R |
| 2,523,494 | 9/1950 | Boughey | 36/72 R |
| 2,836,909 | 6/1958 | Richards | 36/72 R |
| 3,241,153 | 3/1966 | Brewer | 36/72 R |
| 3,271,888 | 9/1966 | Graham et al. | 36/72 R |
| 3,470,630 | 10/1969 | Wilmanns et al. | 36/72 R |
| 4,231,170 | 11/1980 | Griswold | 36/72 R |
| 4,542,598 | 9/1985 | Miseuch et al. | 36/107 |

FOREIGN PATENT DOCUMENTS

| | | | |
|---|---|---|---|
| 2055549 | 3/1981 | United Kingdom | 36/107 |

*Primary Examiner*—Henry S. Jaudon
*Assistant Examiner*—Steven N. Meyers
*Attorney, Agent, or Firm*—Robert B. Frailey

[57] ABSTRACT

This invention relates to a safety shoe which is similar to the structure and function of a sport shoe comprising a conventional tennis shoe type sole receiving a steel plate therein provided at the front end with a plurality of slots, a shoe upper face attached to said sole being divided into a vamp section and two side portions, said side portions provided with two pairs of first and second pockets, a toe lining attached to the inner face of said vamp section to form a bag, a front cover disposed in said bag to protect the wearer's toes, a facing partly overlapping said side portions and provided along the inner margins with a plurality of eyelets through which a lace may pass, a pair of fixing laces being anchored on the opposite sides of said facing, a protecting cover provided on the opposite sides with two pairs of first and second legs which correspond to said first and second pockets overlaying said facing with its first and second legs respectively inserting into said first and second pockets of said side portions and fixed in position by said fixing laces and an insole coming with a front wall being positioned on said sole.

1 Claim, 5 Drawing Figures

SAFETY SHOE

BACKGROUND OF THE INVENTION

This invention relates to a safety shoe and in particular to the type which is similar to the structure and function of a sport shoe.

A safety shoe is used to prevent the wearer's foot from being injuried when the wearer is engaged in a dangerous work.

Commonly used safety shoe (7), as shown in FIG. 5, is generally of the leather shoe type and provided with a front cover (71) made of steel or other similar materials which is positioned on the vamp section of said shoe and glued thereon to prevent the wearer's toes from being injuried, and further provided with a hard sole (72) of which the edge extends to form a platform to prevent the wearer's foot from being pierced. However the connection between said front cover (71) and the vamp section of said sole is only by gluing, hence it is too weak to endure a violent collision, and since the front cover is only located on the vamp section of said shoe to protect the wearer's toes, the instep of the wearer's foot is still unprotected. Furthermore said sole is so hard that it is difficult for the wearer to bend his foot, hence it is not suitable for the wearer to climb up to a height during his work.

Another disadvantage is that the facing (73) of said shoe (7) provided with a plurality of eyelets overlaps only the instep of the wearer's foot, thus it is impossible for the wearer to adjust the tightness and looseness of the joint girth of his foot.

Still another disadvantage is that the extending platform of said sole of said commonly used safety shoe will make rolling objects easily roll up to and injure the instep of the wearer's foot.

It is, therefore, an object of the present invention to obviate the above-mentioned drawbacks.

SUMMARY OF THE INVENTION

It is the primary object of the present invention to provide a safety shoe of which the structure is similar to a sport shoe.

It is another object of the present invention to provide a safety shoe, wherein the sole receives a steel plate therein which is formed at the front end with a plurality of slots to increase the flexibility of the sole and to make the wearer's foot easily bent.

It is still another object of the present invention to provide a safety shoe, wherein a front cover is secured to the inner face of the vamp section of the shoe by means of both gluing and rivetting to reinforce the connection therebetween It is a further object of the present invention to provide a safety shoe, wherein a protecting cover is positioned on the top of the facing of said shoe to provide a further protection for the instep of the wearer's foot.

DETAILED DESCRIPTION OF THE PREFERRED EMBODIMENT

Figure 3:
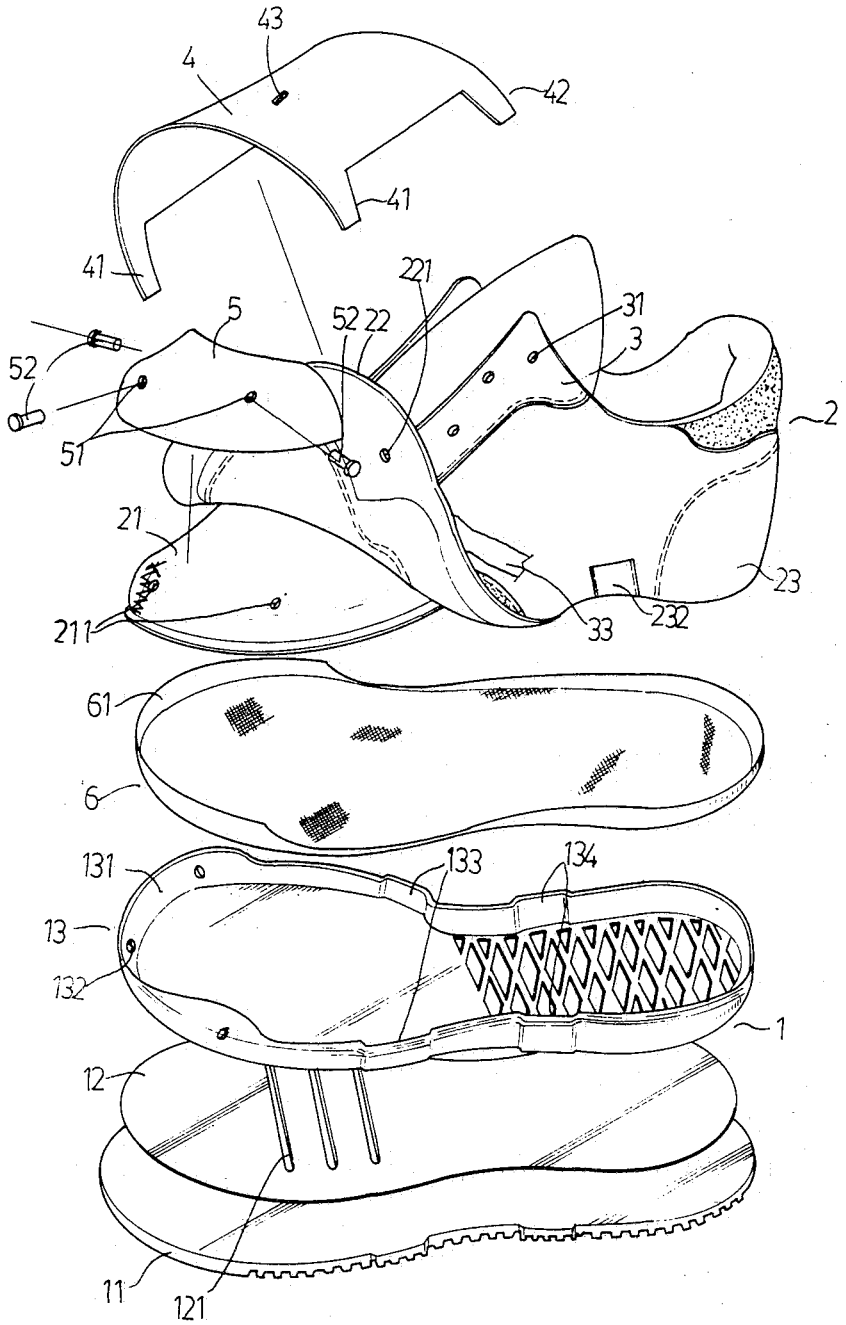
FIG. 3 is a fragemental perspective view of a preferred embodiment of the present invention.
Figure 4:
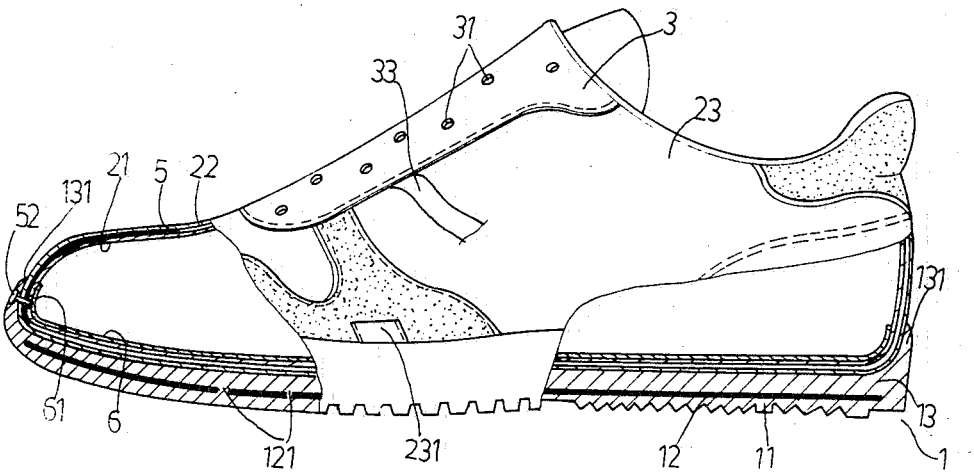
FIG. 4 is a local cross-sectional view of FIG. 3.
Figure 5:
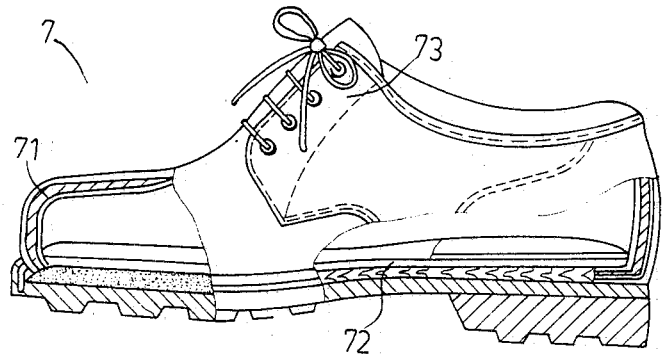
FIG. 5 is a local cross-sectional view of a commonly used safety shoe.

Referring to the specific embodiment of the invention selected for illustration in the accompanying drawings and in particular to FIGS. 3 and 4. A safety shoe (10) comprises a tennis shoe type sole (1) consisting of a bottom sole (11), a steel plate (12) properly provided at the front end with a plurality of slots (121) to increase the flexibility of the sole (1) and to make the wearer's foot easily bent being connected to the top of said bottom sole (11) and an outer sole (13) provided around its periphery with a fixing wall (131) being attached to the top of said steel plate (12), the front end of said fixing wall (131) being provided with a plurality of first holes (132), and two pairs of first and second recesses (133) (134) being respectively formed on the opposite sides of said fixing wall (131). Said bottom sole (11), steel plate (12) and outer sole (13) can be formed integrally with known techniques to produce a complete sole (1).

A shoe upper face (2) attached to the fixing wall (131) of the outer sole (13) of said sole (1) is divided into a vamp section (22) and two symnetrical side portions (23). Said vamp section (22) provided at the front end with a plurality of second holes (221) which correspond to said first holes (132), and said side portions (23) provided at the opposite sides with two pairs of first and second pockets (231) (232) which correspond to said first and second recesses (133) (134). A reinforcing toe lining (21) provided at the front end with a plurality of fourth holes (211) which correspond to said second holes (221) is attached to the inner face of said vamp section (22) by means of seaming and gluing to form a bag (which is not shown).

A front cover (5) preferably made of steel provided around its periphery with a plurality of third holes (51) which correspond to said first, second and fourth holes (132) (221) (211) is positioned in and secured to said bag formed between said vamp section (22) and said toe lining (21).

A facing (3) provided along the inner margins with a plurality of eyelets (31) through which a lace (32) (FIG. 2) may pass partly overlaps said side portions (23) and extends to the vamp section (22) of said shoe face (2) to provide a flexible adjustment for the tightness or looseness of the joint girth of the wearer, and a pair of fixing laces (33) are respectively anchored on the opposite sides of said facing (3).

A protecting cover (4) provided on the opposite sides with two pairs of first and second legs (41) (42) which correspond to said first and second pockets (231) (232) overlays said facing (3) and said protecting cover (4) is further provided with two properly spaced apertures (43) through which said fixing laces (33) may pass to fix said protecting cover (4) in position.

An insole (6) provided with a front wall (61) is positioned on the top of said outer sole (13) of said sole (1) to comfort the wearer's toes.

In assembling, the front cover (5) is positioned into the bag which is formed between said vamp section (22) and said toe lining (21) and secured therein in such a manner that said front cover (5) is firstly glued to said vamp section (22) and toe lining (21) and then a plurality of rivetting members (52) which correspond to the third holes (51) of said front cover (5) are passed in sequence through said first (132), second (221), third (51), fourth holes (211) and rivetted thereon to provide a reinforced attachment for said front cover (5).

Said shoe face (2) is attached to the fixing wall (131) of said outer sole (13) of said sole (1) in commonly used techniques, for example, by means of seaming, and a lace (32) passing through the eyelets (31) of said facing (3) may be properly tied thereover.

An insole (6) is positioned on the outer sole (13) of said sole (1) with its front wall (61) against the rivetting members (52) to prevent the wearer's toes from directly contacting said rivetting members (52) hence to make the wearer's toes more comfortable.

A protecting cover (4) is located on the top of said facing (3) in such a manner that the first and second legs (41) (42) thereof are respectively inserted into the first and second pockets (23) (232) of said side portions (23) and supported on the first and second recesses (133) (134) of said outer sole (13). It is noted that the protecting cover (4) instead of closely contacting the instep of the wearer's foot, keeps a proper distance from said instep thereof by means of the first and second legs (41) (42) respectively supported on the first and second recesses (133) (134) of said outer sole (13), hence said protecting cover (4) to the instep of the wearer's foot is similar to the safety helmet to the wearer's head, thus it may provide a better and reliable protection to the wearer's foot. After said protecting cover (4) has been properly disposed on above-noted position, the fixing laces (33) may pass through the apertures (43) of the protecting cover (4) and be properly tied over said protecting cover (4).

Figure 1:
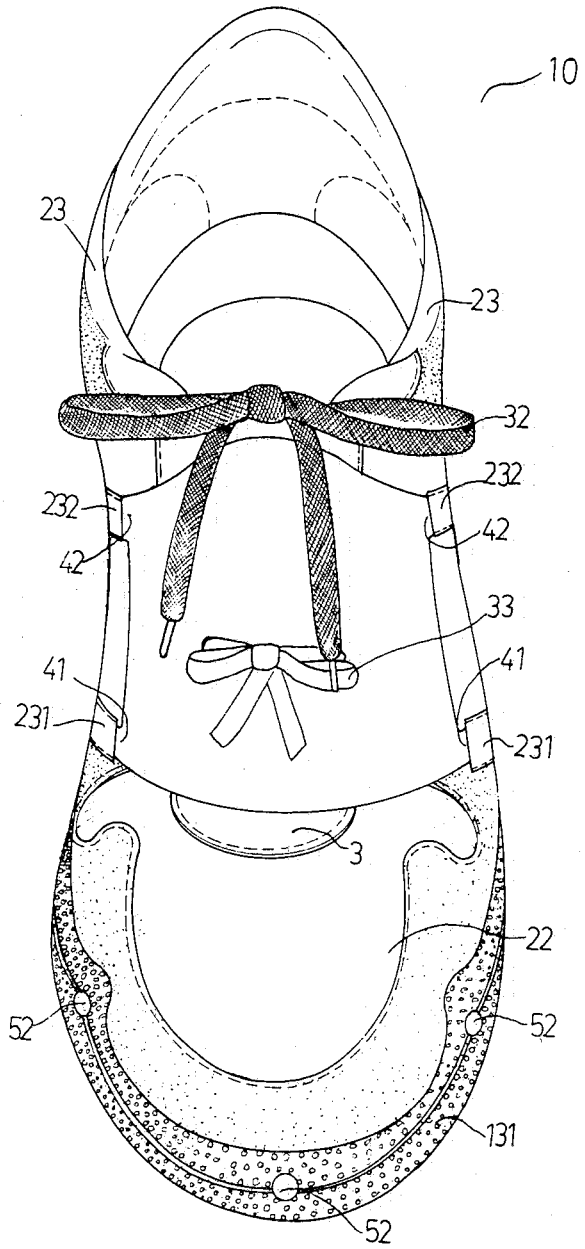
FIG. 1 is a perspective view of a preferred embodiment of the present invention.
Figure 2:
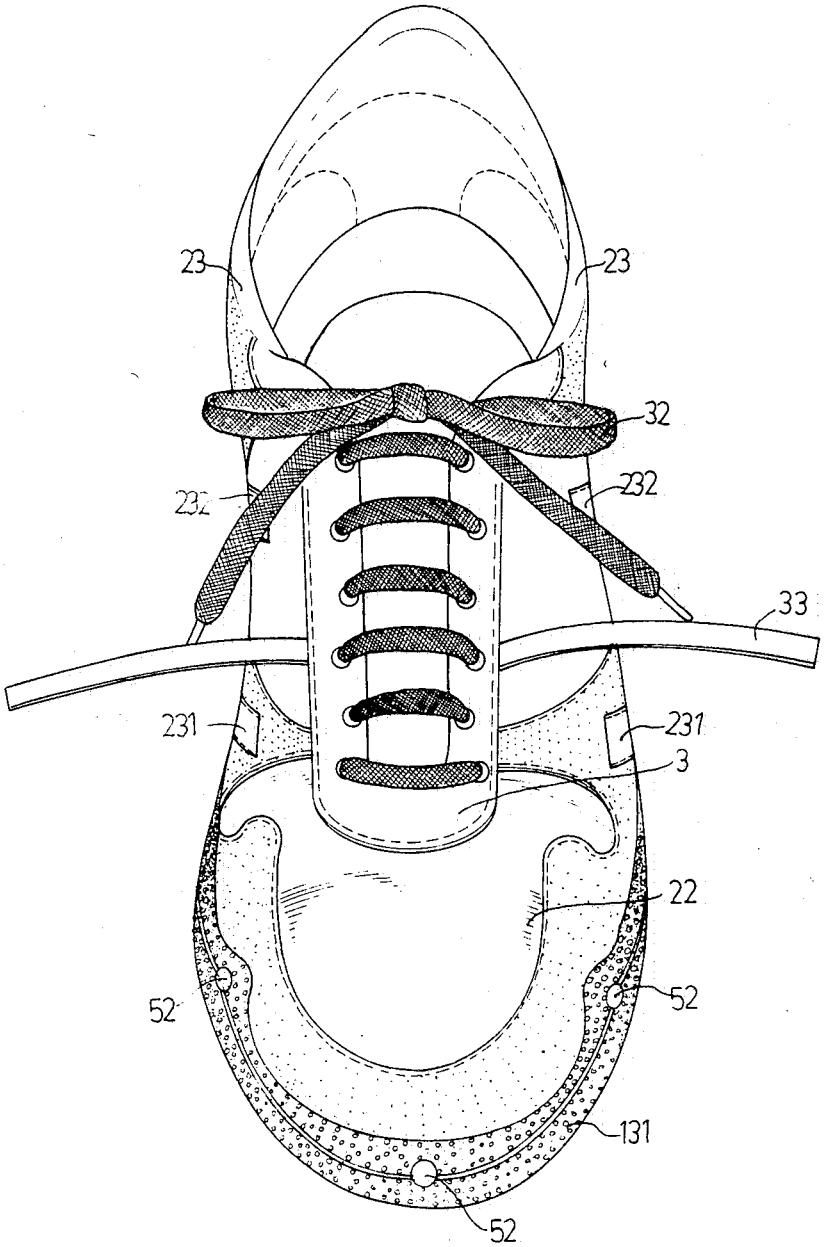
FIG. 2 is a perspective view of the present invention, wherein a protecting cover as shown in FIG. 1 is taken away.

In use, the protecting cover (4) originally is taken away from the safety shoe (10) as shown in FIG. 2, and when the wearer's foot is placed within the shoe (10), said lace (32) may be tightly tied over the facing (3) to prevent the wearer's foot from sliding out said shoe (10). Then, as shown in FIG. 1 the protecting cover (4) is properly located on the top of said facing (3) in above-mentioned way and keeps a proper distance from there. Said fixing laces (33) passing the apertures (43) thereof are tightly tied over said protecting cover (4) and fix said protecting cover (4) in position. Now, the wearer's foot may be under a better and reliable protection.

Conclusively, a safety shoe (10) according to the present invention is provided on the vamp section (22) with a front cover (5) and on the facing (3) with a protecting cover (4) to provide a complete protection for the toes and instep of the wearer's foot. Furthermore, since the sole (1) of the safety shoe (10) comprises a steel plate (12) provided at the front end with a plurality of slots (121), it may increase the flexibility of the sole (1) to make the wearer's foot easily bent and hence to be more suitable for climbing up to a height during his work, and since the sole (1) of the safety shoe (10) is a tennis shoe type sole, it will prevent the rolling objects from easily rolling up to the instep of the wearer's foot hence can provide a better protection for the wearer's foot.

In addition, the safety shoe (10) is of the type which is similar to the structure and function of a sport shoe hence it is more comfortable for the wearer's foot in contrast to the prior art of the leather shoe type.

I claim:

1. A safety shoe which is similar to the structure and function of a sport shoe, comprising:

a conventional tennis shoe type sole consisting of a bottom sole, a steel plate provided at the front end with a plurality of slots to increase the flexibility of said sole and to allow the wearer's foot to be easily bent, said plate being connected to the top of said bottom sole and an outer sole provided around its periphery with a fixing wall being attached to the top of said steel plate, the front end of said fixing wall being provided with a plurality of first holes, two pairs of first and second recesses being respectively formed on the opposite sides of said fixing wall;

a shoe upper face attached to the fixing wall of said outer sole being divided into a vamp section and two side portions, said vamp section provided at the front end with a plurality of second holes corresponding to said first holes of said outer sole, said side portions provided on the opposite sides with two pairs of first and second pockets corresponding to said first and second recesses of said outer sole, a toe lining provided at the front end with a plurality of fourth holes corresponding to said second holes of said vamp section, said lining being attached to the inner face of said vamp section;

a front cover provided around its periphery with a plurality of third holes corresponding to said first, second and fourth holes positioned between said vamp section and toe lining and secured thereto;

a plurality of rivetting members corresponding to said third holes of said front cover being passed in sequence through said first, second, third, fourth holes and rivetted thereon to provide a reinforced attachment for said front cover;

a facing provided along inner margins of the side portions with a plurality of eyelets through which a lace may pass partly overlapping said side portions of said shoe upper face and extending to the vamp section of said shoe upper face to provide a flexible adjustment for the tightness or looseness of the joint girth of the wearer, a pair of fixing laces being respectively anchored on the opposite sides of said facing;

a protecting cover provided on the opposite sides with two pairs of first and second legs corresponding to said first and second pockets of said side portions overlaying said facing with its first and second legs respectively inserted into said first and second pockets of said side portions and supported on said first and second recesses of said outer sole, said protecting cover further provided with two properly spaced apertures through which said fixing laces may pass to fix said protecting cover in position;

an insole provided with a front wall being positioned on the top of said outer sole to prevent the wearer's toes from directly contacting said rivetting members.

* * * * *